US007663498B2

(12) United States Patent
Lafaye et al.

(10) Patent No.: US 7,663,498 B2
(45) Date of Patent: Feb. 16, 2010

(54) LOCKABLE SIGNALLING COLUMN

(75) Inventors: Michel Lafaye, Soyaux (FR); Didier Severac, Rueil Malmaison (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 385 days.

(21) Appl. No.: 11/579,411

(22) PCT Filed: Apr. 21, 2005

(86) PCT No.: PCT/EP2005/051778

§ 371 (c)(1),
(2), (4) Date: Apr. 3, 2007

(87) PCT Pub. No.: WO2005/114042

PCT Pub. Date: Dec. 1, 2005

(65) Prior Publication Data

US 2009/0123994 A1 May 14, 2009

(30) Foreign Application Priority Data

May 4, 2004 (FR) ..... 04 04746

(51) Int. Cl.
*G08B 3/00* (2006.01)

(52) U.S. Cl. ..... 340/691.1

(58) Field of Classification Search ..... 340/691.1, 340/691.6, 693.5; 359/436
See application file for complete search history.

(56) References Cited

U.S. PATENT DOCUMENTS

| | | | | |
|---|---|---|---|---|
| 4,453,268 | A * | 6/1984 | Britt | 382/273 |
| 2001/0028308 | A1* | 10/2001 | De La Huerga | 340/573.1 |
| 2003/0236876 | A1* | 12/2003 | Curtin et al. | 709/224 |
| 2004/0008123 | A1* | 1/2004 | Carrender et al. | 340/825.49 |

FOREIGN PATENT DOCUMENTS

| | | |
|---|---|---|
| EP | 1 239 214 | 9/2002 |
| FR | 1 526 306 | 5/1968 |
| FR | 2 128 998 | 10/1972 |
| WO | 95 28598 | 10/1995 |

* cited by examiner

*Primary Examiner*—Phung Nguyen
(74) *Attorney, Agent, or Firm*—Oblon, Spivak, McClelland, Maier & Neustadt, L.L.P.

(57) ABSTRACT

The invention relates to a signaling column with levels which are assembled by a relative pivoting limited in amplitude and interconnected by axially-extending conductors. The body of a level includes a locking bar which extends axially to penetrate an opening in an adjacent level and abuts an edge of the opening on a rotation attempt. The ends of the bar may be displaced and the opening is of such a size as to accommodate the top end of a relevant bar and the bottom end of the bar above.

9 Claims, 3 Drawing Sheets

LOCKABLE SIGNALLING COLUMN

BACKGROUND OF THE INVENTION

I. Field of the Invention

The present invention relates to a signaling column composed of signaling levels, in particular optical signaling levels, which are superposed on one another and fixed to one another by pivoting about the axis of the column.

II. Description of Related Art

The levels of such a column each have a body which comprises a lateral wall and a cover, and accommodate a signaling member and conductors which are distributed over the periphery of the body and extend parallel to the axis to ensure an electrical connection with the signaling member. Such a column is known, for example, from the document FR 2 128 998. The body comprises means for assembling to the adjacent body by pivoting of limited amplitude and means for interconnecting which ensure, during pivoting, a continuing connection between the different levels.

The various levels are assembled by relative pivoting, preferably by a bayonet-type mounting of a body of a level on the body of an underlying level. The mounting is very simple, which means that the dismantling is also very simple. To replace a level or to work on the signaling member of a level, it suffices to pivot the upper level, with the levels which are superposed thereon, in order to dismantle the entire part of the column surmounting the relevant level. It is sometimes desirable to prevent instant dismantling of a level relative to the underlying level, in order to avoid intervention by an unauthorized operator.

BRIEF SUMMARY OF THE INVENTION

The object of the invention is to lock the levels in a manner which is simple and well adapted to the configuration of a signaling column and which provides the desired protection against untimely dismantling.

According to the invention, the body has a lock consisting of a bar which extends axially with a first end accessible by a tool and a second end capable of penetrating an opening of the adjacent body and capable of abutting against an edge of the opening to prevent the pivoting of the body, the bar being displaceable to adopt two axially distinct positions, one a retracted locked position and the other an extended unlocked position.

The opening is preferably made in an upper face of the cover which is perpendicular to the axis of the column and the bar preferably has a uniform section over its entire length. The ends of the locking bar may be offset, the opening being dimensioned to accommodate the first end of the relevant bar and the second end of the adjacent bar.

The first end of the bar, which is preferably its upper end, may advantageously have an eyelet for operating the tool and may be countersunk relative to the upper surface of the cover in the locked position, the operation being facilitated by the opening having a radially flared shape.

The bar may be easily guided in translation in the axial direction of the column by guide surfaces provided in the upper cover and guide elements provided in the lower part of the body.

The detailed description which follows illustrates an embodiment given by way of example, with reference to the accompanying drawings, in which:

DETAILED DESCRIPTION OF THE INVENTION

Figure 1:
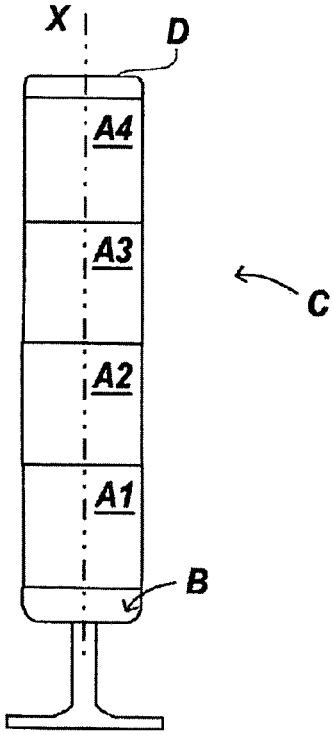
FIG. 1 shows an elevation of a signaling column according to the invention.
Figure 2:
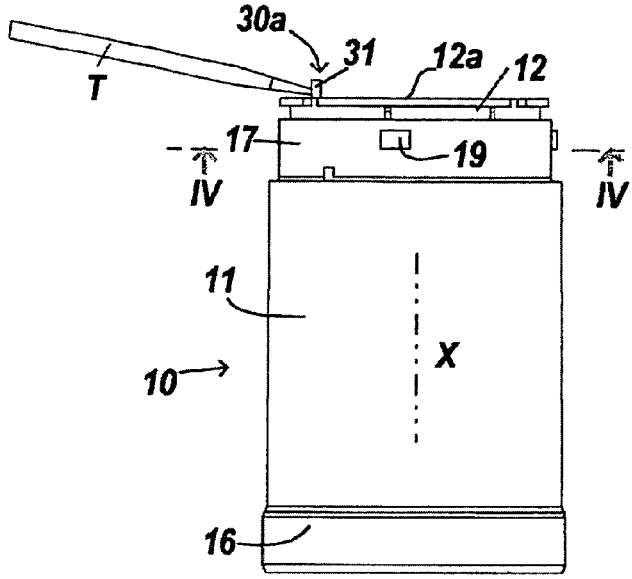
FIG. 2 is a side view of one level of the column.
Figure 3:
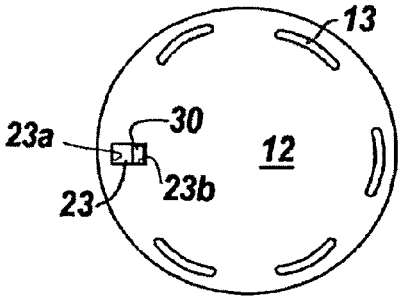
FIG. 3 is a top view of the level of FIG. 2.

The signaling column C illustrated in the figures comprises a plurality of superposed signaling levels or modules A. As is seen in FIG. 1, the column C extends along a vertical axis X and has four levels A1-A4 fixed to one another, the lowest level A1 being fixed to a base B which ensures the passage of electrical conductors, the uppermost level A4 being preferably covered by a lid D. The column may, naturally, have a variable number of levels. One level is mounted onto an underlying level by a bayonet-type movement, with pivoting of limited amplitude, for example at an angle of less than 30°.

Figure 4:
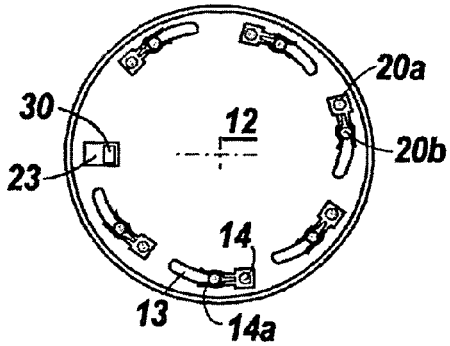
FIG. 4 illustrates, by means of a schematic section according to IV-IV, the interconnection of superposed levels.
Figure 5:
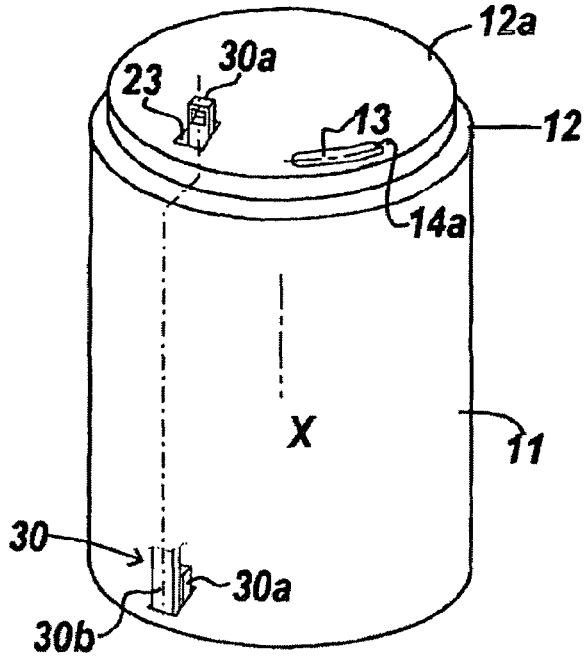
FIG. 5 shows in schematic perspective one level of the column.
Figure 6:
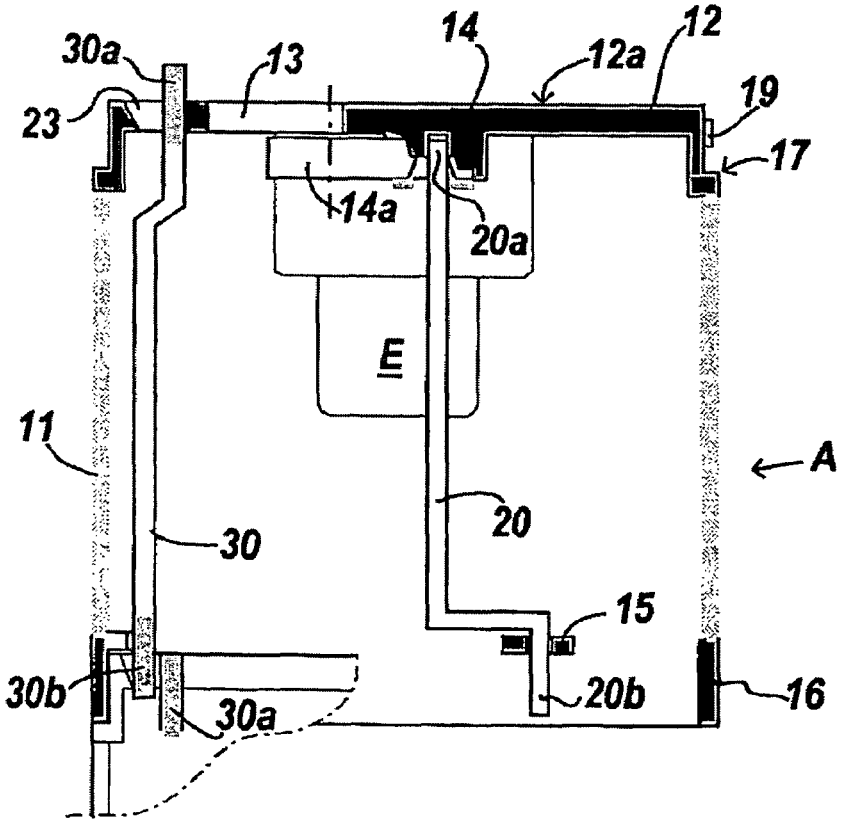
FIG. 6 shows schematically the interconnection and the locking of superposed levels.

The body 10 of a level A accommodates a plurality of conductors 20 in the form of beads (see FIGS. 4 and 6). These conductors ensure the supply and transmission of signaling signals toward the various levels, which obviously assumes an interconnection of the ends 20*a*, 20*b* of the homologous conductors belonging to the superposed levels. The body 10 has a cylindrical or prismatic wall 11 with an axis X. The wall 11 is translucent and, for example, colored when the signaling is illuminated, and may be opaque in other cases. The body is provided with an upper cover 12, of which the upper face 12*a* extends transversely to the axis X. The cover 12 is provided on its periphery with a plurality of inwardly curved passages 13 and, on the inside, insulating contacts 14 adjacent to these passages and designed to receive clip connectors 14*a* which accommodate the ends 20*a*, 20*b* of conductors to be interconnected. On its lower part, opposing the cover, the body 10 has retaining elements 15 for the lower ends 20*b* of the conductors 20 and a lower part 16. The lower part 16 is provided with shapes 18 for coupling to the upper part 17 of the underlying level, for example of the bayonet type, to cooperate during assembly by pivoting with homologous coupling shapes 19 of the underlying level. The cover 12 bears a signaling member E to which the ends 20*a* of the conductors 20 accommodated in the body of the relevant level are connected.

A lock 30 consisting of an axial bar extends inside the body 10, substantially over the height thereof. The bar 30 is essentially rigid and guided in translation in the direction X by guide surfaces 21 provided in the cover 12 and guide elements 22 provided in the lower part of the body. The bar 30 may, at its upper end 30*a*, pass through an opening 23 made in the cover 12, by being guided in this opening, to project beyond the surface 12*a* of the cover 12; the end 30*a* of the bar 30 is not widened and has an eyelet 31 to receive the tip of a tool T. At its lower end 30*b*, the bar 30 is guided in the elements 22 and may penetrate an opening of the cover 12 of the underlying level, preferably consisting of the opening 23 already provided in this cover. It is noteworthy that the opening 23 has, on the one hand, an edge 23*a* radially flared towards the outside and, on the other hand, a lateral abutment edge 23*b*.

The opening 23 is, therefore, dimensioned to accommodate the upper end 30*a* of the bar 30 of the relevant level and the lower end 30*b* of the superposed level. It will be noted that the bars are formed with ends 30*a*, 30*b* which are slightly radially offset, and have a uniformly straight section over their entire length.

The locking bar 30 is capable of adopting an upper unlocked position, in which its upper end 30*a* projects relative to the upper surface 12*a* of the cover, and a locked lower position, in which its upper end 30*a* is countersunk relative to the surface 12*a*. The maintenance of these positions is partially ensured by the friction against the guide surfaces 21, 22. It is preferable to provide stop elements 32, such as snap connections or hard points, to maintain the bar in these two positions.

Figure 7:
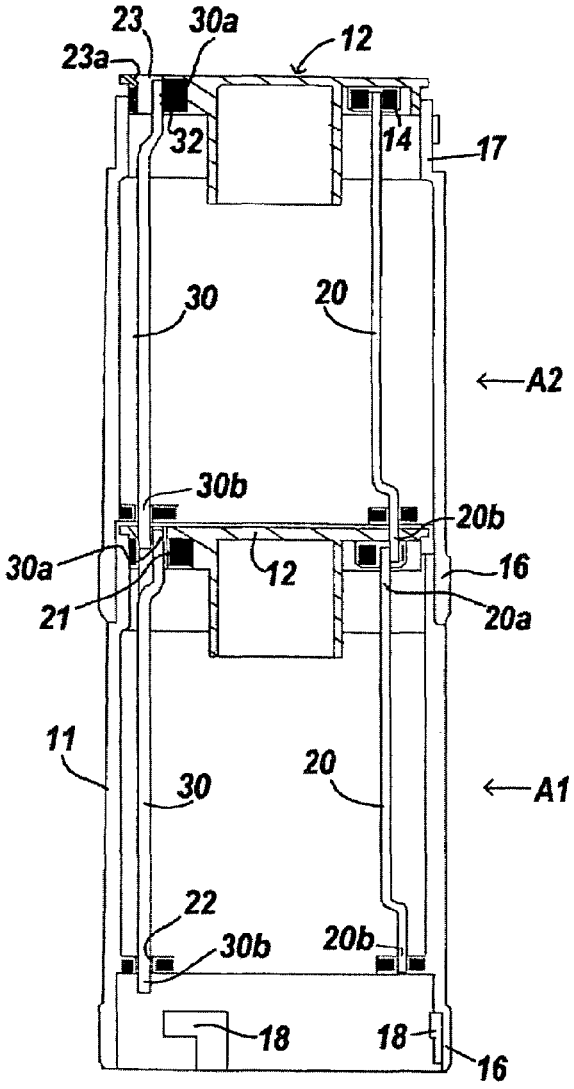
FIGS. 7 & 8 illustrate the locking and respectively the unlocking of two levels of the column.
Figure 8:
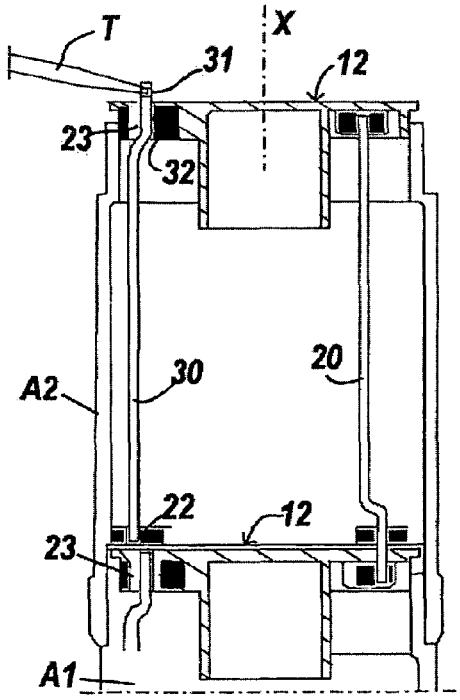

The mounting of one level of the column on the underlying level will be explained with reference to FIGS. 7 and 8. To be assembled to the underlying level (for example denoted in this case A1), the upper level (for example denoted in this case A2) is initially advanced in the direction X, with axial interlocking of the lower part 16 of A2 into the upper part 17 of A1. Then the operator pivots the body of A2 about the axis X to obtain the interlocking of the shapes 18 of A2 onto the shapes 19 of A1. During these coupling movements, the locking bar 30 of A2 is in the upper unlocked position so as not to act on the cover of A1. The pivoting is carried out over an angle which depends on the configuration of the elements 13, 14*a*, 20, in this case of the order of the angular extension of the passages 13. When the pivoting is terminated, the lower ends 20*b* of the conductors 20 of A2 are inserted in the connectors 14*a* of A1. The assembled position is thus confirmed and secured by the operator who lowers the bar 30 of A2, manually or by means of the tool T, in guided translation through the opening 13, the surfaces 21 and the elements 22. The translation is carried out until the insertion of the end 30*b* of the bar in the opening 23 of the cover of A1. As is seen in FIG. 7, the end 30*b* of the bar 30 of A2 is accommodated adjacent to the end 30*a* of the bar 30 of A1 and thus contributes to the blocking of said bar.

When attempting to dismantle A2, the locking bar 30 abuts against the lateral edge 23*b* of the opening 23. To remove the level A2 it is necessary to unblock its bar 30 by raising by means of the tool T in order to bring the bar into the position indicated in FIG. 8. The introduction of T into the eyelet 24 is facilitated by the flared form provided to the external radial edge 23*a* of the opening 23.

The invention claimed is:

1. A signaling column comprising:

a plurality of signaling levels superposed on one another and fixed to one another by rotation about an axis, the levels each having a body including a lateral wall and a cover and accommodating a signaling member and conductors distributed over a periphery of the body and extending parallel to the axis to ensure an electrical connection with the signaling member, wherein the body includes a means for assembling to an adjacent body by pivoting of limited amplitude, and a means for connecting that ensures an interconnection of the levels during pivoting, and the body includes a lock including a bar which extends axially and has a first end accessible by a tool and a second end configured to penetrate an opening of the body of an adjacent level and configured to abut against an edge of the opening to prevent the pivoting of the body, the bar being displaceable to adopt two axially distinct positions, a retracted locked position and an extended unlocked position.

2. The signaling column as claimed in claim 1, wherein the first end of the bar is an upper end, and the opening is made in an upper face of the cover which is perpendicular to the axis.

3. The signaling column as claimed in claim 2, wherein the upper end of the bar includes an eyelet for operating the tool and is countersunk relative to the upper surface of the cover in the locked position.

4. The signaling column as claimed in claim 2, wherein the bar is guided in translation in a direction by guide surfaces provided in the upper cover and guide elements provided in a lower part of the body.

5. The signaling column as claimed in claim 1, wherein a section of the locking bar is uniform over its length, the first and second ends of the bar are offset, and the opening is configured to accommodate the first end of the bar and the second end of a bar of the adjacent level.

6. The signaling column as claimed in claim 1, wherein the opening made in the cover to accommodate the upper end of the bar has an outwardly flared radial edge.

7. The signaling column as claimed in claim 1, wherein the body includes a cylindrical or prismatic wall.

8. The signaling column as claimed in claim 7, wherein the wall is translucent.

9. The signaling column as claimed in claim 1, further comprising:

stop elements configured to maintain the bar in either the locked or unlocked positions.

* * * * *